US011919553B1

(12) United States Patent
Schalk

(10) Patent No.: US 11,919,553 B1
(45) Date of Patent: Mar. 5, 2024

(54) RAILROAD SWITCH POSITION INDICATOR

(71) Applicant: David A. Schalk, Festus, MO (US)

(72) Inventor: David A. Schalk, Festus, MO (US)

( * ) Notice: Subject to any disclaimer, the term of this patent is extended or adjusted under 35 U.S.C. 154(b) by 814 days.

(21) Appl. No.: 17/069,105

(22) Filed: Oct. 13, 2020

Related U.S. Application Data

(60) Provisional application No. 62/913,332, filed on Oct. 10, 2019.

(51) Int. Cl.
*B61L 5/16* (2006.01)

(52) U.S. Cl.
CPC ..... *B61L 5/16* (2013.01)

(58) Field of Classification Search
CPC ..... B61L 5/10; B61L 5/12; B61L 5/16
See application file for complete search history.

(56) References Cited

U.S. PATENT DOCUMENTS 3,544,960 A * 12/1970 Hayes ..... B61L 7/081 246/473 R
7,735,784 B2 * 6/2010 Schalk ..... B61L 5/10 246/476
8,695,928 B1 * 4/2014 Schalk ..... B61L 5/10 246/476
10,766,511 B2 * 9/2020 Schalk ..... B61L 5/10
2010/0025546 A1 * 2/2010 Rivas ..... B61L 5/02 246/410
2010/0072326 A1 * 3/2010 Click ..... B61L 5/02 246/393

FOREIGN PATENT DOCUMENTS

WO 2017044908 A1 3/2017

* cited by examiner

*Primary Examiner* — Robert J McCarry, Jr.
(74) *Attorney, Agent, or Firm* — Grace J. Fishel

(57) ABSTRACT

A railroad switch position indicator configured for direct attachment to switch points which guide a train from one track to another. The indicator has first and second rotating reflector signals spring biased into a neutral position signaling caution. The first rotating reflector signal rotates in response to movement of the switch points against the spring bias while the second rotating reflector signal remains in neutral position when the switch points are lined for a first direction. The second rotating reflector signal rotates in response to movement of the switch points against the spring bias while the first set of reflectors remain in neutral position when the switch points are lined for a second direction.

15 Claims, 6 Drawing Sheets

RAILROAD SWITCH POSITION INDICATOR

BACKGROUND OF THE INVENTION

Field of the Invention

The present invention relates to a railroad switch position indicator with rotating reflector signals directly attached to the switch points through a cable.

Brief Description of the Prior Art

A railroad switch is a mechanical installation enabling railway trains to be guided from one track to another, such as at a railway junction or where a spur or siding branches off. The switch consists of a pair of linked tapering rails, known as the switch points, lying between the diverging outer rails. These points can be moved laterally into one of two positions to direct a trains coming from the point blades toward the straight path or the diverging path.

A mechanism is provided to move the points from one position to the other. Historically, this would require a lever to be moved by a human operator, and some switches are still controlled this way. However, most are not operated by a remotely controlled electric motor or by pneumatic or hydraulic actuation, called a point machine.

A switch position indicator or switch indicator is associated with the point machine. If the switch target is ambiguous, bent, or incorrectly mounted it makes it misleading and can lead to a derailment. Switch points are the only true verifier of direction of travel; and the subject switch point indicator directly corresponds to the switch points. This enables operators to double check every single switch, and reduce possible derailments.

BRIEF SUMMARY OF THE INVENTION

In view of the above, it is an object of the present invention to provide a switch indicator which may be mounted as a replacement for a target usually associated with a switch machine. It is another object to provide a switch point indicator that directly corresponds to movement of the switch points. A still further object is to provide a switch point indicator that provides a directional indicator in addition to a color indicator. Other objects and features of the invention will be in part apparent and in part pointed out hereinafter.

In accordance with the invention, a railroad switch position indicator is configured for direct attachment to the switch points with a first and second set of rotating reflectors spring biased into a neutral position signaling caution. The first set of reflectors is rotated in response to movement of the switch points against the spring bias while the second set of reflectors remain in neutral position when the switch points are lined for straight through or diverging. The second set of reflectors is rotated in response to movement of the switch points against the spring bias while the first set of reflectors remain in neutral position when the switch points are lined for the opposite of the first set of reflectors.

In important embodiments as shown in the drawings, the railroad switch position indicator has indicia on the rotating reflectors for indicating that the switch points are correctly aligned.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
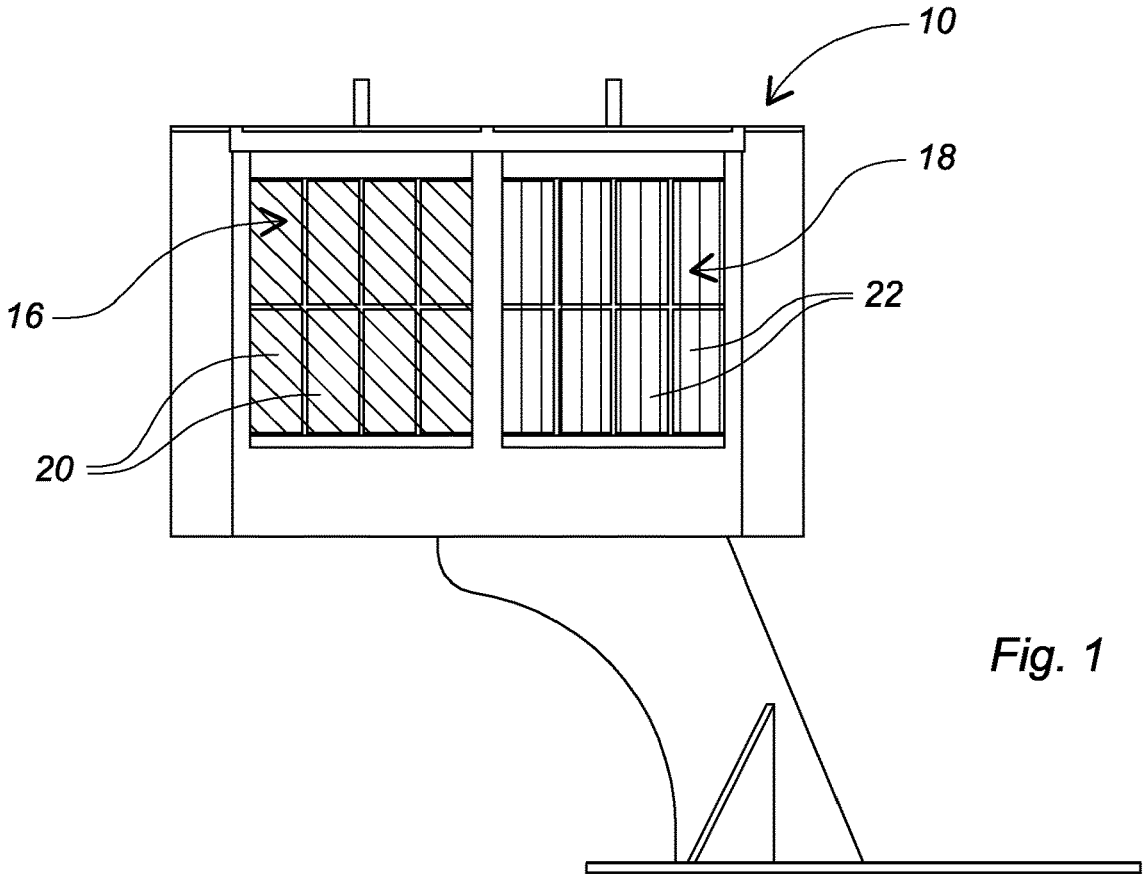
FIG. 1 is a front elevation of a railroad switch position indicator in neutral position, the rear elevation being a mirror image.

Referring to the drawings more particularly by reference character, reference character 10 refers to a switch point indicator in accordance with the present invention. Switch point indicator 10 is actuated by movements of a crossbar connecting the inner stockrails of a switch as described in WO 2017/044908 A1 which is incorporated by reference herein.

Figure 2:
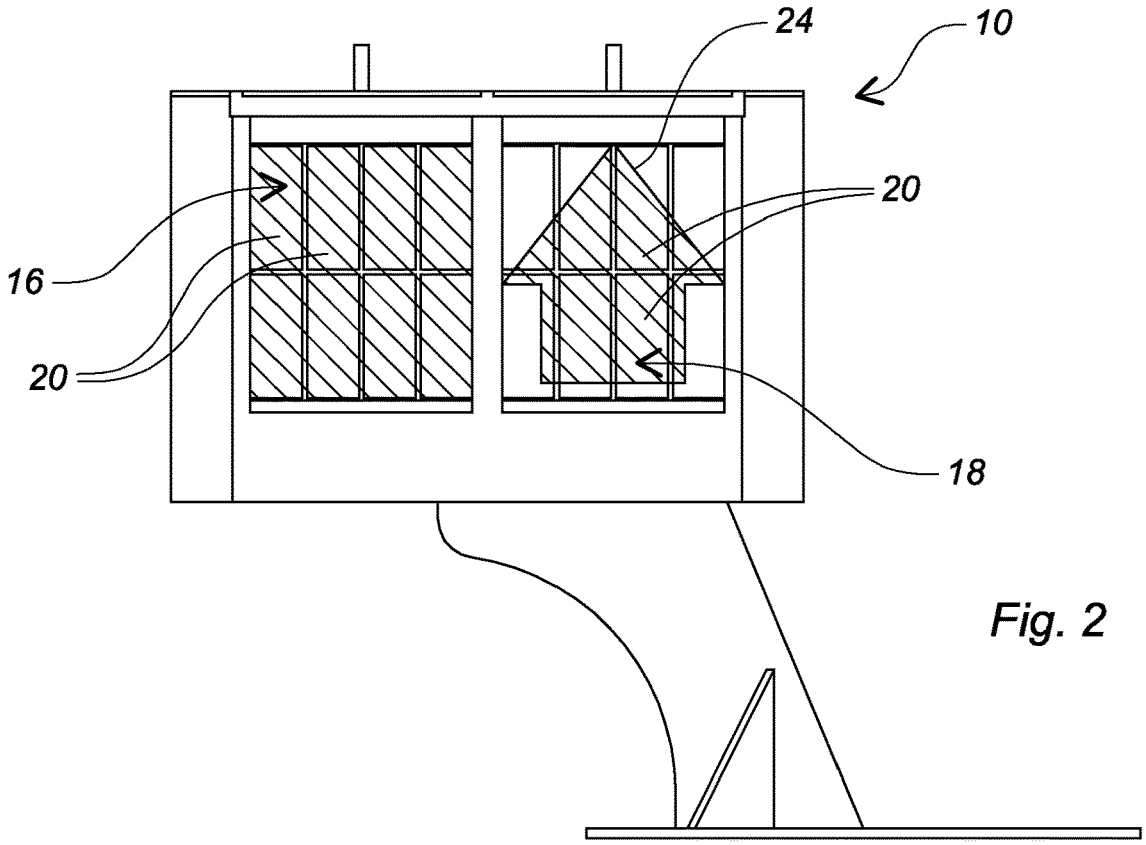
FIG. 2 is a front elevation of the indicator in aligned straight position, the rear elevation being a mirror image.
Figure 3:
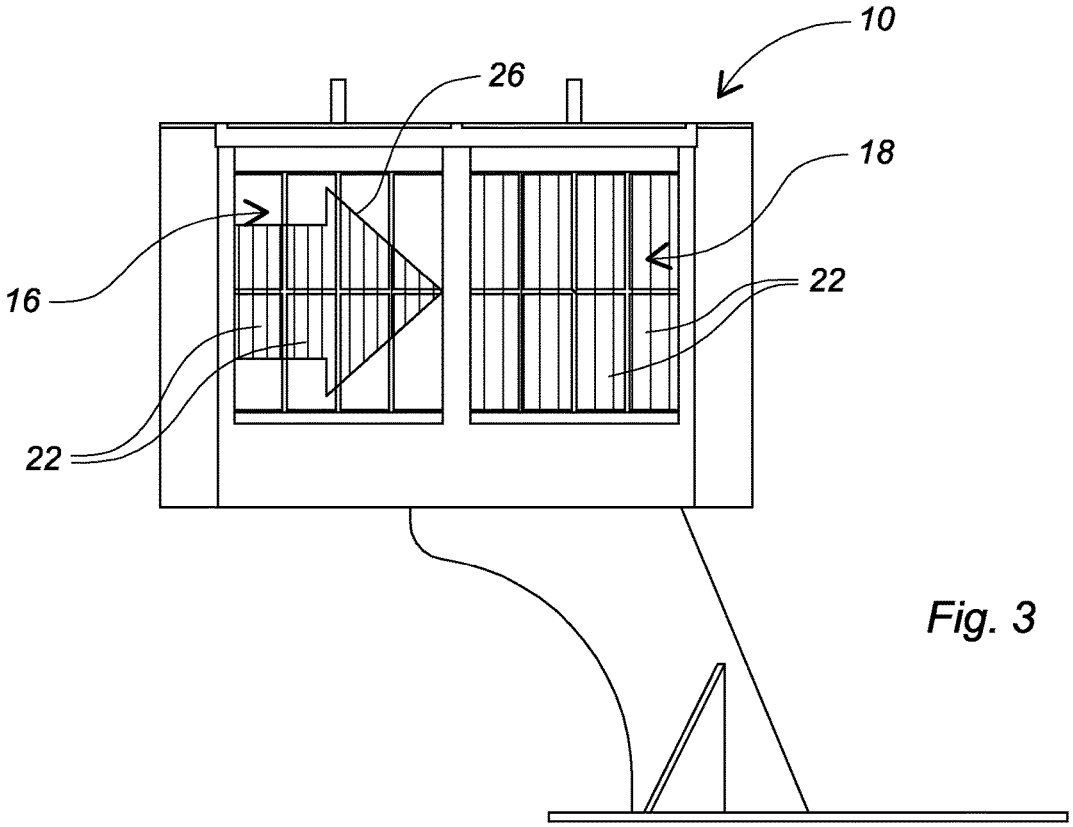
FIG. 3 is a front elevation of the indicator in aligned diverging position, the rear elevation being a mirror image.

As shown in FIGS. 1-3, switch point indicator 10 has a cover 12 with a front face and a rear face (not seen), each of which a window 14 through which a first and second orthogonal shaped signals 16, 18, respectively are seen. Signals 16, 18 are spring biased in neutral position as shown in FIG. 1. As shown, first signal 16 has reflectors 20 lined for the color green and second signal 18 has reflectors 22 lined for the color red as seen through window 14. The selection of the green and red colors is arbitrary and other contrasting colors, indicia and black and white may be used. Reflectors 18, 20 may be faceted such that they reflect light from all viewing angles. The reflectors may also be backlit with lights and the top of cover 12 may include a window for ambient light.

Turning then to FIG. 2, second signal 18 is shown rotated ninety degrees such that reflectors 22 lined for the color green are seen through window 14 signaling alignment in a first direction such as for straight through. An arrow 24 pointed in the direction of straight or other indicia may be provided as a further aid to signal understanding. As shown in FIG. 3, first signal 16 is shown rotated ninety degrees such that reflectors 22 lined for the color red are seen through window 14 signaling alignment in a second direction such as for diversion. A second arrow 26 pointed in the direction of diversion may be provided.

Figure 4:
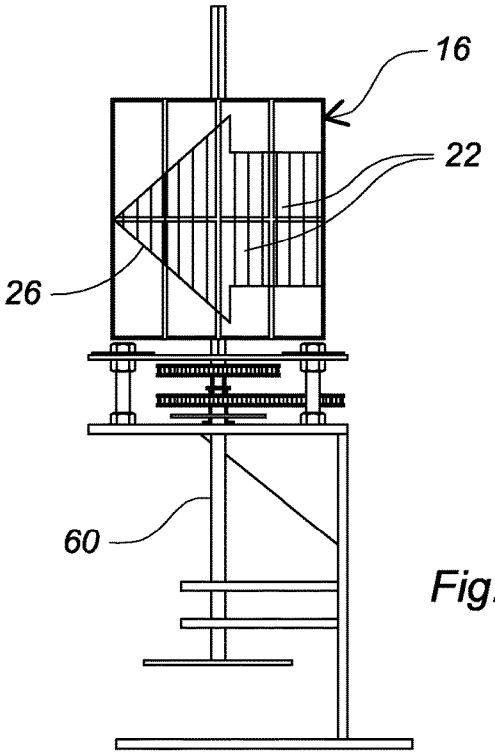
FIG. 4 is a left side view of the indictor in neutral position with a cover removed.
Figure 5:
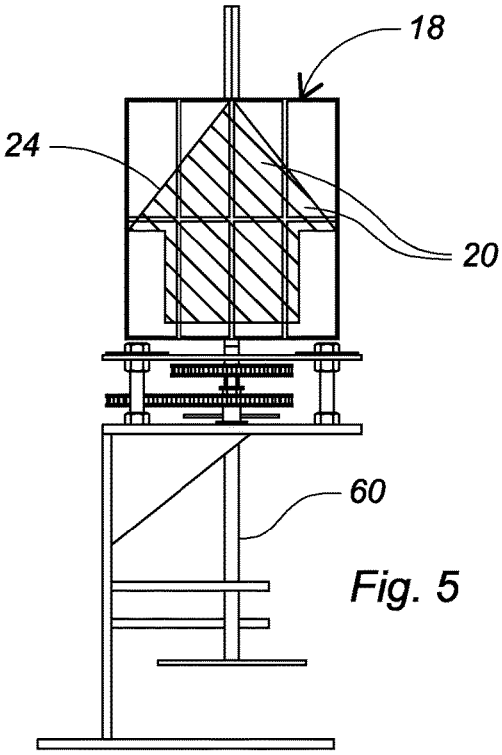
FIG. 5 is a right side view of the indicator in neutral position.
Figure 6:
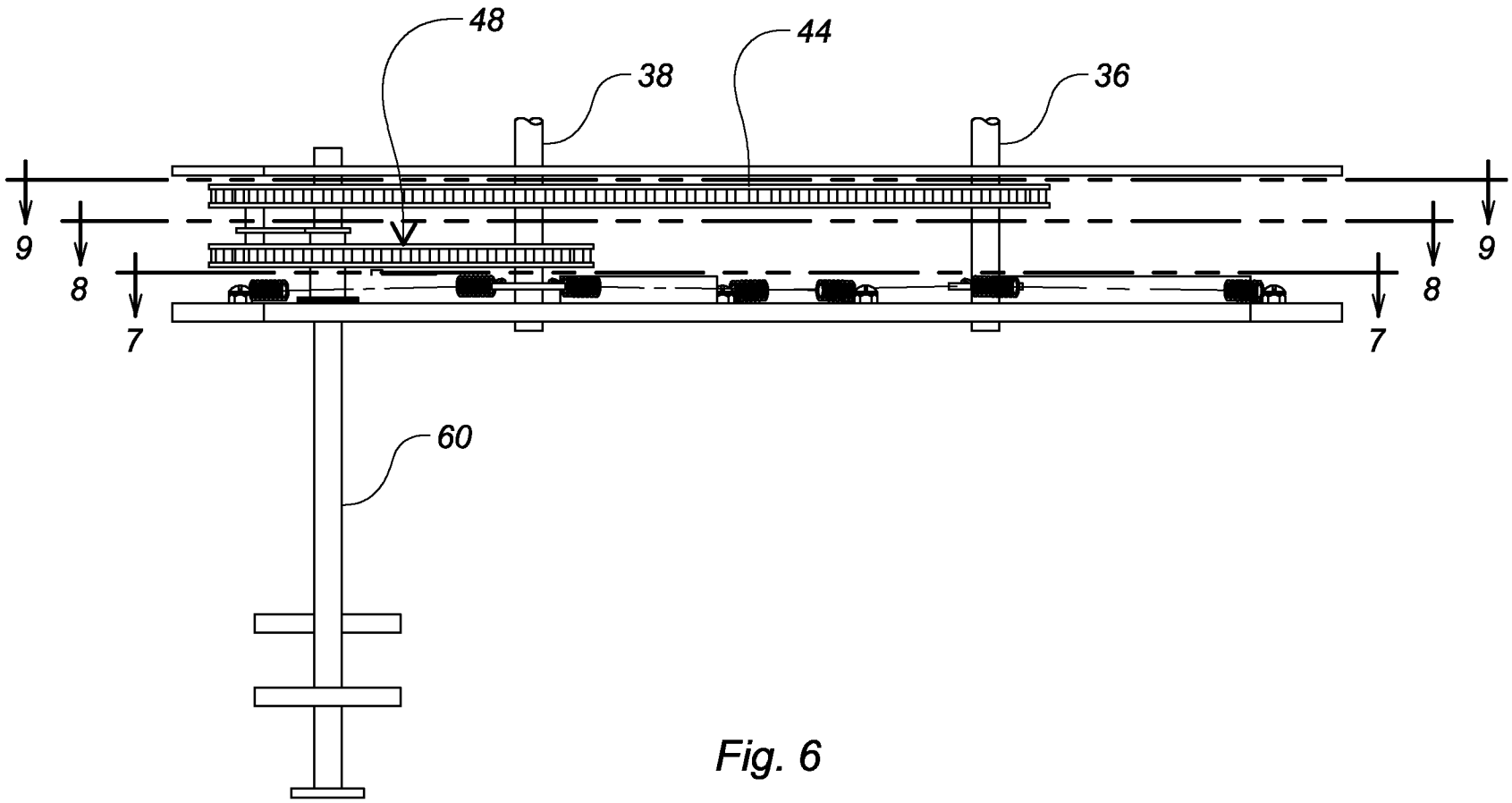
FIG. 6 is an assembled sectional view taken along the plane of 5-5 in FIG. 11.
Figure 11:
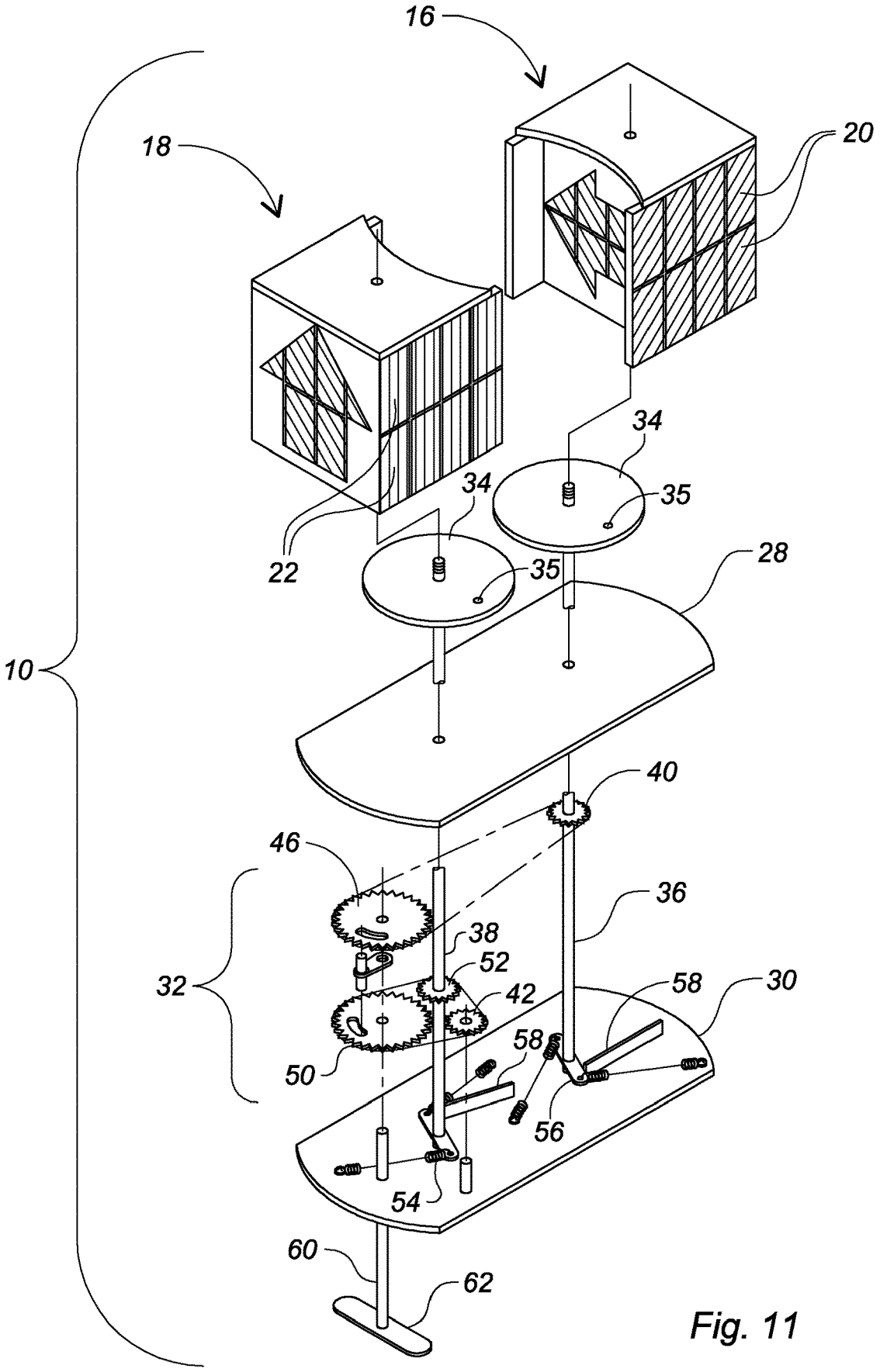
FIG. 11 is an exploded perspective view of the indicator in neutral position viewed from the right side with the cover removed.

With cover 12 removed, as best seen in FIG. 11 taken in combination with FIGS. 4-5, first and second signals 16, 18 are orthogonal shaped structures with reflectors 20, 22 of the same color on opposite sides and reflectors 20, 22 of the other color on the adjacent sides. Indicia 24, 26 when present are provided as mirror images on the opposite sides such that indicator 10 reads the same through window 14 viewed from the front or back.

Figure 7:
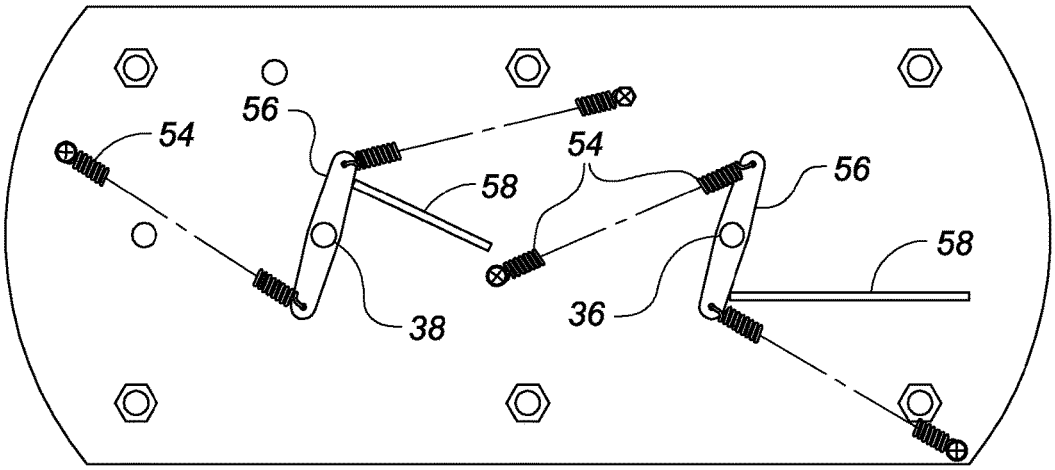
FIG. 7 is a plan sectional view taken along the plane of 7-7 in FIG. 6.
Figure 8:
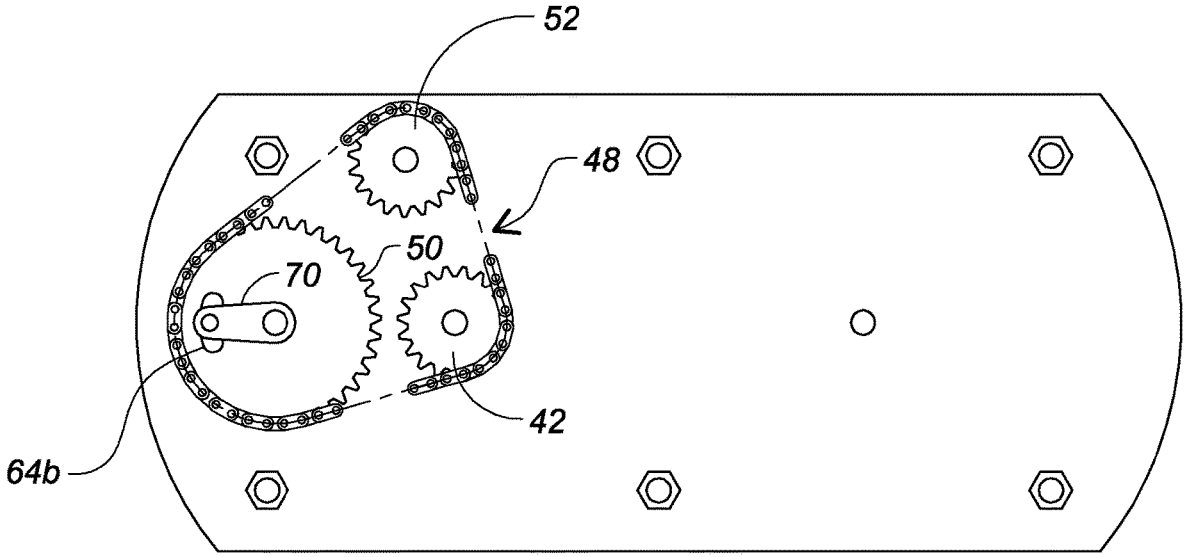
FIG. 8 is a plan sectional view taken along the plane of 8-8 in FIG. 6.
Figure 9:
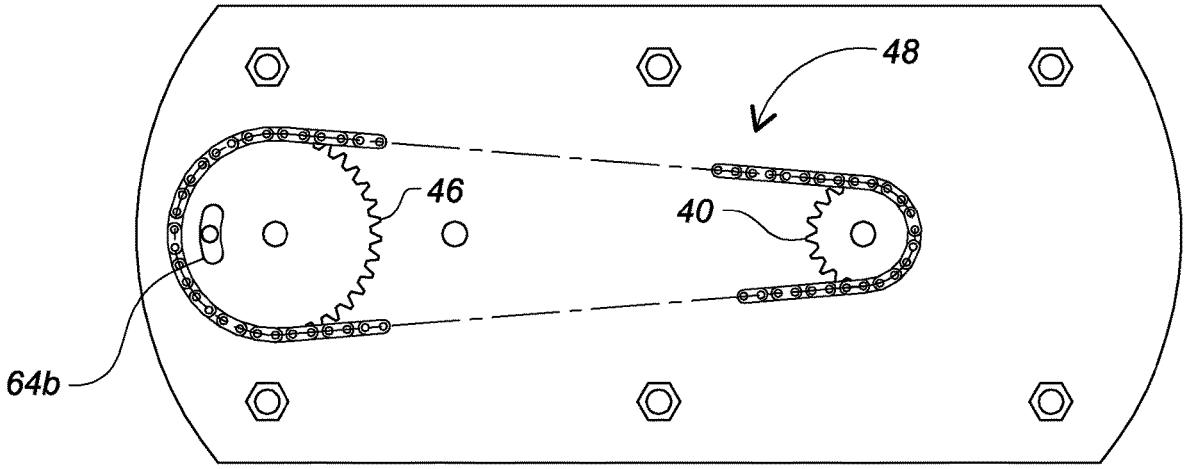
FIG. 9 is a plan sectional view taken along the plane of 9-9 FIG. 6.

With continuing reference to FIG. 11, indicator 10 includes an upper support 28 and vertically aligned lower support 30 between which is sandwiched a drive mechanism 32 responsive to movements of the switch points. Each of first and second signals 16, 18 is mounted on a plate 34 with alignment holes 35. Plate 34 is keyed or pinned for rotation with first and second driven shafts 36, 38, respectively. First and second driven shafts 36, 38 protrude through upper support 28 and rotate on lower support 30. A first driven sprocket 40 is keyed or pinned to first driven shaft 36 and a second driven sprocket 42 is keyed or pinned to second driven shaft 38. As best seen in FIG. 9, a first drive train 44 (FIG. 9) connects first driven sprocket 40 with a first drive sprocket 46. Drive train includes a chain or belt with indentations into which the teeth of the sprocket is received. In like manner, as seen in FIG. 8, a second drive train 48 connects second driven sprocket 42 with a second drive sprocket 50. Second drive train 48 includes an idler sprocket 52 which may be omitted with a different length belt or chain. Continuing downward through cross sections 7-9, it is seen in FIG. 7 that each of first and second driven shafts 36, 38 is spring biased. Springs are 54 are attached to opposing arms of a connecting member 56 which is keyed or pinned to the driven shaft. A stop 58 is provided to prevent overturning of the shafts past neutral position.

Figure 10:
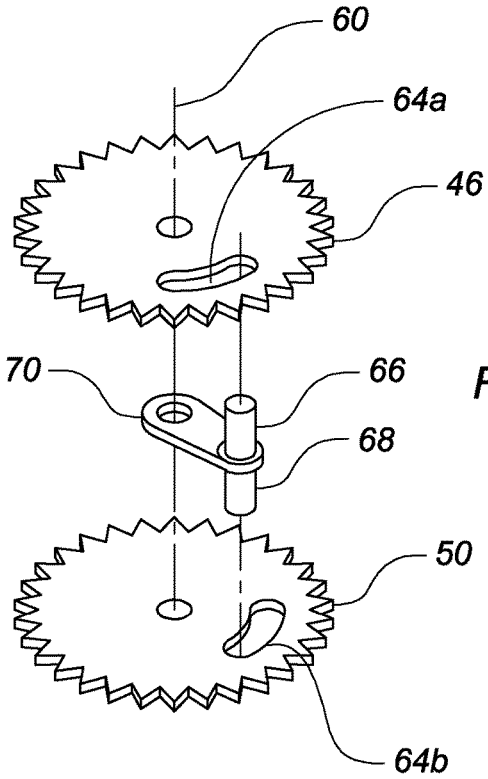
FIG. 10 is a perspective detail showing fingers for activating first and second drive gears.

Turning back to FIG. 11, first and second drive sprockets 46, 50 are freely mounted on a drive shaft 60 which is rotated in response to movement of the switch points through a cable attachment (not shown) connected to a member 62. Each of first and second drive sprockets 46, 50 has an arcuate slot 64*a*, 64*b* respective into which is received a first and second finger 66, 68, respectively. Fingers 66, 68 are vertically aligned and mounted on an arm 70 which is keyed or pinned to drive shaft 60. As best seen in FIG. 10, opposite ends of arcuate slots 64*a*, 64*b* are vertically aligned for use as described below.

In the embodiment shown in the drawings, each of arcuate slot 64*a*, 64*b* extends 45 degrees and first and second drive sprockets 46, 50 are vertically arranged such that the end of one slot is above the beginning of the second slot in neutral indicator switch position (FIG. 1). When drive shaft 60 is rotated counter clockwise as shown in FIG. 10, finger 66 rotates first drive sprocket 46 causing first drive train to rotate first driven sprocket 40 and first signal 16. The system is calibrated such that when finger 68 reaches the opposite end of arcuate slot 64*b*, first signal 16 has rotated 90 degrees into signaling position. Meanwhile second finger 68 is rotated through second arcuate slot 64*b* and second drive sprocket 50 remains unmoved. For the rotation of first signal 16 to be 90 degrees, the drive ratio between socket 46 and 40 is 2 to 1. It will be apparent that arcuate slots 64*a*, 64*b* may be longer or shorted than 45 degrees and the same result may be accomplished with different drive ratios between the sockets. When drive shaft 60 is rotated clockwise by 45 degrees, finger 68 in arcuate slot 64*b* causes second signal 18 to rotate 90 degrees.

In use, when switch point indicator 10 signals straight through as shown in FIG. 2, first driven shaft 36 with first signal 16 is rotated against the force of springs 54 by movement of finger 66 against the end wall of arcuate slot 64*a* in first drive sprocket 46 while second signal 18 remains stationary in neutral position under force of springs 54. Until first signal 16 is completely rotated, switch indicator 10 signals caution. As shown, indicia 24 may be provided to indicate that the switch is lined straight through.

When switch point indicator 10 indicates diverging as shown in FIG. 3, second signal 18 is rotated against the force of springs 54 by movement of finger 68 against an end wall of arcuate slot 64*b* in second drive sprocket 50. Meanwhile finger 66 moves through first arcuate slot 64*a* in first drive sprocket 46 and first signal 16 remains stationary in neutral position. Until second signal 18 is completely rotated, switch indicator 10 signals caution. As shown, indicia 26 may be provided to indicate the switch is lined diverging.

A default position of switch indicator is shown in FIG. 1. Unless positively driven by finger 66 or 68, springs 54 on first and second driven shafts 36, 38, cause first and second signals 16, 18 to display a mixed set of reflectors, the mixture signaling caution. As disclosed in WO 2017/044908 A1 the cable attached to switch point indicator 10 does not start to rotate drive shaft 60 until the switch points approach ¼ inch of the stock rails. At that point, the cable begins to rotate drive shaft 60 and the appropriate one of signals 16, 18 into signaling position. Until the signal being rotated is rotated a full ninety degrees, indicating that the switch points are close enough to the stockrails to avoid derailing, switch point indicator 10 signals caution.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A railroad switch position indicator configured for direct attachment to switch points, said indicator having first and second rotating reflector signals spring biased into a neutral position signaling caution, said first rotating reflector signal rotated in response to movement of the switch points against the spring bias while the second rotating reflector signal remains in neutral position when the switch points are lined for a first direction, said second rotating reflector signal rotated in response to movement of the switch points against the spring bias while the first set of reflectors remain in neutral position when the switch points are lined for a second direction.

2. The railroad switch position indicator of claim 1 having indicia on the rotating reflector signals which indicate that the switch points are correctly aligned in the first or second direction.

3. A railroad switch position indicator comprising first and second rotating signals spring biased into a neutral position signaling caution, said first and second signals mounted on first and second driven shafts, respectively, said first and second driven shafts connected to first and second driven sprockets, respectively, said first and second driven sprockets connected by first and second drive trains to first and second drive sprockets respectively, said first and second drive sprockets rotating on a drive shaft configured for connection to switch points, said first and second drive sprockets having first and second arcuate slots with aligned opposing ends in a neutral position respectively, a first and second vertically aligned finger received in the first and second arcuate slots respectively and rotating with the drive shaft, said first and second drive sprockets and said first and second driven sprockets having a gear ratio such that movement of the first finger with the drive shaft carrying the second finger to the end of the second arcuate slot results in a ninety degree rotation of the first signal signaling alignment in a first direction and movement of the second finger with the drive shaft in an opposite direction carrying the first finger to the end of the first arcuate slot results in a ninety degree rotation of the second signal signaling alignment in a second direction.

4. The railroad switch position indicator of claim 3 wherein the signals are orthogonal shaped with reflectors of a first color on opposing sides and reflectors of a second color on opposing sides.

5. The railroad switch position indicator of claim 4 wherein indicia indicating alignment in the first direction are provided on opposing sides of the first signal and wherein indicia indicating alignment in the second direction are provided on opposing sides of the second signal.

6. The railroad switch position indicator of claim 3 wherein the first and second arcuate slots are 45 degrees and the drive socket and driven socket in the first and second drive trains have a gear ratio of 2 to 1.

7. The railroad switch position indicator of claim 3 wherein the first and second arcuate slots are vertically aligned such that the end of the first slot aligns with the beginning of the second slot.

8. The railroad switch position indicator of claim 3 wherein the first and second fingers are mounted on an arm keyed or pinned to the drive shaft.

9. The railroad switch position indicator of claim 4 further comprising a cover with windows in a front and a rear through which the signals are read.

10. A railroad switch position indicator comprising an upper and lower support between which is sandwiched a drive mechanism responsive to movement of switch points, a first and second drive shaft rotate on the lower support and pass through the upper support, first and second rotating orthogonal shaped signals are mounted above the upper support on the first and second drive shafts respectively, said drive mechanism comprising a first and second driven sprocket mounted on the first and second driven shafts respectively, said first and second driven sprockets connected by a first and second drive train to a first and second drive sprocket respectively, said first and second drive sprockets rotating on a drive shaft, said first and second drive sprockets having a first and second arcuate slot with aligned opposing ends in a neutral position, a first and second vertically aligned finger received in the first and second arcuate slots respectively and rotating with the drive shaft, said first and second drive sprockets and said first and second driven sprockets having a gear ratio such that movement of the first finger with the drive shaft carrying the second finger to the end of the second arcuate slot results in a ninety degree rotation of the first signal signaling alignment in a first direction and movement of the second finger with the drive shaft in an opposite direction carrying the first finger to the end of the first arcuate slot results in a ninety degree rotation of the second signal signaling alignment in a second direction.

11. The railroad switch position indictor of claim 10 wherein the first and second driven shafts are spring biased such that the first and second signals signal caution in neutral position.

12. The railroad switch position indicator of claim 10 wherein the orthogonal shaped signals have reflectors of a first color on opposing sides and reflectors of a second color on opposing sides.

13. The railroad switch position indicator of claim 12 wherein indicia indicating alignment in the first direction are provided on opposing sides of the first signal and wherein indicia indicating alignment in the second direction are provided on opposing sides of the second signal.

14. The railroad switch position indicator of claim 10 wherein the first and second arcuate slots are 45 degrees and the drive socket and driven socket in the first and second drive trains have a gear ratio of 2 to 1.

15. The railroad switch position indicator of claim 14 wherein the first and second arcuate slots are vertically aligned such that the end of the first slot aligns with the beginning of the second slot.

* * * * *